US005131547A

United States Patent [19]

Goldberg

[11] Patent Number: 5,131,547

[45] Date of Patent: Jul. 21, 1992

[54] COLLAPSIBLE STORAGE RACK

[76] Inventor: Kenneth Goldberg, 2106 W. Lunt, Chicago, Ill. 60645

[21] Appl. No.: 798,522

[22] Filed: Nov. 26, 1991

[51] Int. Cl.[5] ..... A47F 5/00

[52] U.S. Cl. ..... 211/149; 211/132; 211/201; 108/112

[58] Field of Search ..... 211/149, 150, 201, 130, 211/132; 108/112, 99

[56] References Cited

U.S. PATENT DOCUMENTS

| | | | |
|---|---|---|---|
| 1,167,558 | 1/1916 | Forsyth . | |
| 3,093,247 | 6/1963 | Erickson | 211/149 X |
| 3,132,745 | 5/1964 | Steiner . | |
| 3,232,442 | 2/1966 | Wilson . | |
| 3,295,471 | 1/1967 | Cook . | |
| 3,388,808 | 6/1968 | Radek . | |
| 4,189,056 | 2/1980 | Majewski . | |
| 4,858,773 | 8/1989 | Zimmermann . | |
| 4,978,013 | 12/1990 | Hogg . | |

FOREIGN PATENT DOCUMENTS

| | | | |
|---|---|---|---|
| 464426 | of 1926 | Australia | 211/201 |
| 966657 | 10/1950 | France . | |
| 1070715 | 8/1954 | France . | |
| 2221831A | 2/1990 | United Kingdom . | |

*Primary Examiner*—Robert W. Gibson, Jr.
*Attorney, Agent, or Firm*—Dressler, Goldsmith, Shore, Sutker & Milnamow, Ltd.

[57] ABSTRACT

A collapsible storage rack assembly includes a plurality of upstanding, generally inverted U-shaped frame members between which extend a plurality of vertically spaced, hingedly collapsible shelf assemblies. The storage rack construction is preassembled, and can be easily and quickly opened for use by moving the frame members away from each other. In a similar manner, the storage rack can be easily collapsed by moving the frame members toward each other and into juxtaposition, with the shelf assemblies collapsing by upward hinging movement. In the closed and collapsed position, the shelf assemblies are substantially completely nested within the frame members, thereby facilitating convenient handling, shipment, and storage of the construction.

13 Claims, 2 Drawing Sheets

COLLAPSIBLE STORAGE RACK

TECHNICAL FIELD

The present invention relates generally to a storage rack assembly, and more particularly to a pre-assembled, collapsible storage rack which can be conveniently opened for use, with shelf assemblies of the rack each movable to an over-center locking position, whereby the rack exhibits a high degree of stability. The construction can be easily moved to a collapsed condition, wherein the shelf assemblies are substantially nested within frame members of the rack for compact storage and shipment.

BACKGROUND OF THE INVENTION

Various types of rack assemblies are known for storage of items. Such rack assemblies typically include a plurality of upright members between which extend vertically spaced, horizontal shelves.

In typical constructions, mechanical fasteners are employed for securing the shelves to the upright members of a rack assembly. While such constructions may exhibit the requisite strength for secure storage of articles, these arrangements can be time-consuming to assemble. Moreover, these types of assemblies do not lend themselves to convenient collapsing, such as for storage and/or shipment. Disassembly can be time-consuming, and potential loss of the relatively small fastener components detracts from efficient use.

The present invention contemplates a storage rack construction which is completely pre-assembled, and which lends itself to convenient opening and collapsing for efficient use, and compact storage and shipment of the construction.

SUMMARY OF THE INVENTION

A collapsible storage rack embodying the principles of the present invention comprises a pre-assembled integrated arrangement of frame members and hinged shelf assemblies which is configured such that the frame members can be conveniently moved relative to each other for folding and unfolding the shelf assemblies. In this manner, the storage rack can be easily and quickly opened for use, and thereafter conveniently collapsed for storage.

Notably, the shelf assemblies are configured for over-center locking when the rack is open, whereby the rack is highly stable during use. Moreover, the shelf assemblies are dimensioned relative to the frame members so that when collapsed, the shelf assemblies are substantially completely nested within the peripheries of the frame members.

In accordance with the illustrated embodiment, the present storage rack includes a plurality of upstanding, generally inverted U-shaped frame members positioned in generally parallel relationship to each other. Each frame member comprises tubular, preferably metallic, material, and includes a pair of spaced apart vertical leg portions, and an upper, horizontal connector portion extending integrally between the leg portions.

The present storage rack further includes a tier of a plurality of vertically spaced, hingedly collapsible shelf assemblies which extend between adjacent ones of the frame members. In one illustrated embodiment, a pair of the frame members are provided, with a plurality of shelf assemblies extending therebetween. In an alternate embodiment, three of the frame members are provided, with a plurality of vertically spaced shelf assemblies extending between each adjacent pair of the frame members. As will be appreciated, a storage rack embodying the principles of the present invention may include two, three, or more of the frame members, with a tier of the vertically spaced shelf assemblies extending between each adjacent pair of the frame members.

Each shelf assembly comprises a pair of shelf portions hingedly joined to each other. The shelf portions are further respectively hingedly joined to the frame members, so that movement of the frame members toward each other folds and collapses each shelf assembly by upward hinging movement thereof.

In order to lend structural integrity and stability to the storage rack when in use, a pair of intersecting cross-braces are positioned to extend between respective ones of the leg portions of each adjacent pair of the frame members. Thus, in the embodiment including a pair of frame members, one pair of intersecting cross-braces is provided, while in the alternate embodiment, including three frame members, two such pairs of cross braces are included. The cross-braces are non-removably pivotally connected to the frame members, and permit the frame members to be moved apart into spaced relationship.

The cross-braces are arranged to secure the frame members in spaced apart relationship when the storage rack is open for use by limiting the movement of the frame members away from each other. In this configuration of the rack, the shelf assemblies extend generally horizontally between the adjacent frame members, with the upwardly facing surfaces of the shelf assemblies thus being positioned for receiving articles thereon. The pivotal connection of the cross-braces to the frame members further permits the frame members to be moved toward each other and juxtaposed for collapsing the shelf assemblies and the storage rack.

Collapsing the storage rack to a compact, conveniently handled configuration is facilitated by vertically spacing the shelf assemblies which extend between adjacent ones of the frame members from each other sufficiently so that the shelf assemblies do not interfere and contact each other when the storage rack is collapsed. Additionally, the uppermost one of the shelf assemblies is spaced sufficiently downwardly from the upper connector portions of the respective frame members so that, when the storage rack is folded with the frame members juxtaposed, the uppermost shelf assembly is positioned beneath the connector portions of the respective frame members. In other words, when folded, the uppermost shelf assembly fits beneath the upper extent of the frame members between which it extends.

To further facilitate compact storage of the collapsed storage rack, each shelf assembly, when folded, has a thickness dimension less than the combined thickness of a pair of the leg portions of the frame members. In this manner, all of the shelf assemblies are substantially nested within the peripheries of the respective adjacent frame members when the frame members are juxtaposed and the shelf is collapsed. This configuration of the storage rack not only promotes storage, but further promotes shipment in that a shipping container for the article can be dimensioned so as to merely encompass the juxtaposed frame members, with all of the shelf assemblies thereby substantially nested and confined within the frame members.

In order to promote secure storage of articles on the rack, one of the shelf portions of each of the shelf assemblies preferably includes locking means engageable with the other shelf portion for locking the shelf portions against downward hinging movement from a generally horizontal position thereof. In the illustrated embodiment, the locking arrangement includes at least one locking finger engageable with an upwardly facing surface of the other shelf portion.

Significantly, at least one, and preferably all, of the shelf assemblies are configured such that each shelf assembly is positioned in an over-center locking position when extending generally horizontally for use of the storage rack. Disposition of each shelf-assembly in this over-center position prevents movement of the frame members toward each other for collapsing the rack. For collapsing, each of the shelf assemblies must be moved upward slightly, hingedly through its center position, whereupon each of the shelf assemblies can be folded hingedly upwardly as the frame members are moved into juxtaposition for collapsing the storage rack.

Stability of the storage rack is enhanced by the cooperation of the over-center locking shelf assemblies with the cross-braces. Specifically, each over-center locking shelf assembly moves through its center position when the respective frame members are at an outer limit of movement away from each other, as limited by the cross-braces. By virtue of the resilience of the structure, each shelf is urged into its over-center position, after being moved through its center position during opening of the rack structure. This arrangement desirably acts to preclude inadvertent or unintended collapsing of the rack.

Other features and advantages of the present invention will become readily apparent from the following detailed description, the accompanying drawings, and the appended claims.

DETAILED DESCRIPTION

Figure 1:
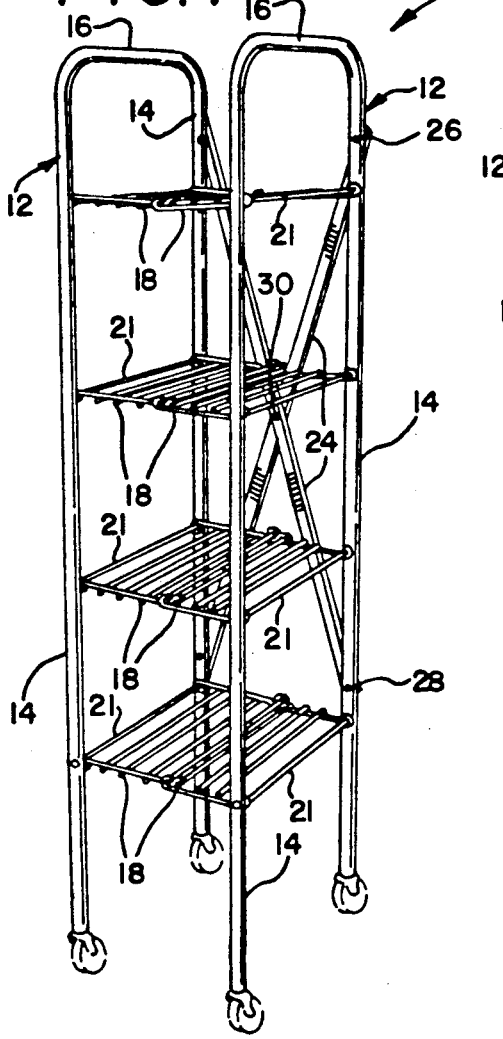
FIG. 1 is a perspective view of a collapsible storage rack embodying the principles of the present invention.

While the present invention is susceptible of embodiment in various forms, there is shown in the drawings and will hereinafter be described first and second presently preferred embodiments of the invention, with the understanding that the present disclosure is to be considered as an exemplification of the invention, and is not intended to limit the invention to the specific embodiments illustrated.

Figure 2:
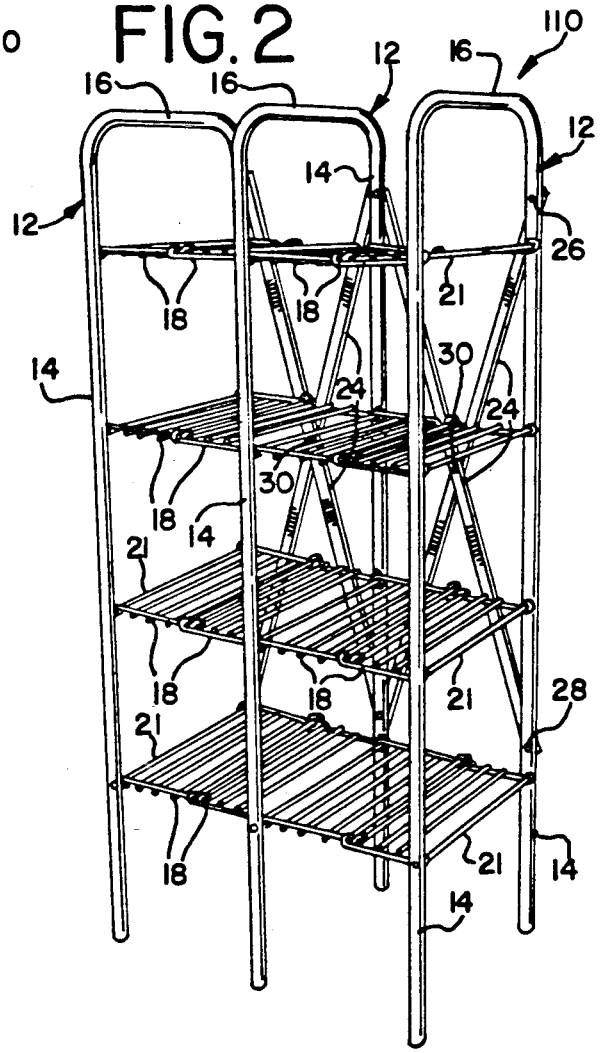
FIG. 2 is an alternate embodiment of a collapsible storage rack embodying the principles of the present invention.

With reference now to FIG. 1, therein is illustrated a collapsible storage rack 10 embodying the principles of the present invention. As is apparent, the storage rack 10 of FIG. 1 includes a single tier of shelf assemblies, as will be further described. In contrast, an alternate embodiment of the present invention, identified as collapsible storage rack 110 shown in FIG. 2, includes two tiers of shelf assemblies, but otherwise includes components in accordance with the embodiment shown in FIG. 1, and is assembled in a similar manner. The versatility of the present storage rack construction will thus be appreciated, since arrangements can be configured to include one, two, three or more tiers of shelf assemblies, as desired, all in keeping with the principles disclosed herein.

Each storage rack 10, 110, includes a plurality of upstanding, generally inverted U-shaped frame members 12 positioned in generally parallel relationship to each other. Each frame member 12 comprises tubular material, preferably steel or other metallic material for durability and economical use, with each of the frame members including a pair of spaced apart vertical leg portions 14, and an upper, horizontal connector portion 16 extending integrally between the leg portions 14.

As shown in phantom line in FIG. 1, the present storage rack can optionally be provided with casters 17 fitted within leg portions 14. When used without casters, plug-like elements are fitted within leg portions 14, thereby finishing the leg portions, while still permitting the frame members to be moved into juxtaposition for collapsing the storage rack to a compact configuration, as will be described.

The storage rack embodying the principles of the present invention further includes a tier of a plurality of vertically spaced, hingedly collapsible shelf assemblies extending between adjacent ones of the frame members 12. Each shelf assembly comprises a pair of shelf portions 18 hingedly joined to each other at hinge point 20, and respectively hingedly joined to the leg portions 14 of the frame members 12 by hinge members 21. In the preferred embodiment, each of the shelf portions 18 comprises a plurality of interconnected metallic wire members which are joined together so that when the storage rack is opened for use, the shelf portions of each shelf assembly present a generally horizontal, upwardly facing surface for receiving articles for storage. The lowermost hinge members 21 are preferably fixedly joined to the frame members 12, thereby precluding the leg portions of the frame members from spreading outwardly.

Figure 4:
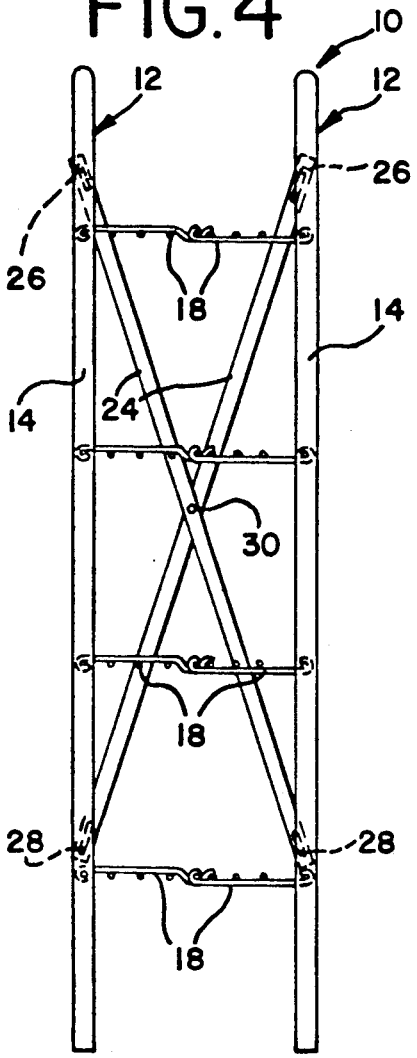
FIG. 4 is a side elevational view of the collapsible storage rack shown in FIG. 1, illustrating the storage rack in an open position for use.
Figure 5:
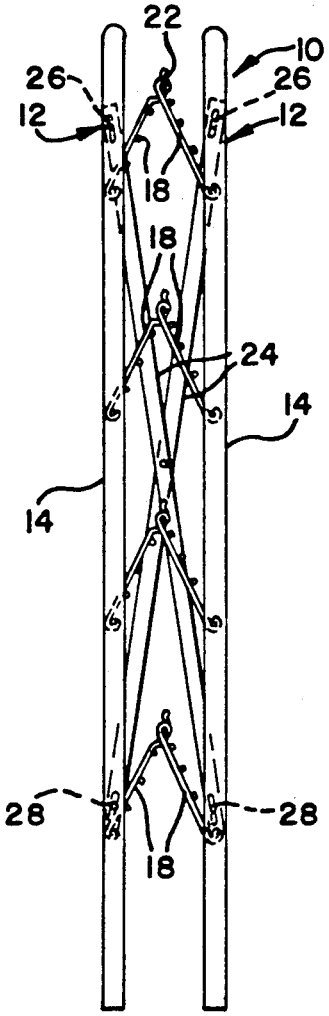
FIG. 5 is a side elevational view of the storage rack shown in FIG. 1, illustrating the storage rack in a partially collapsed position.
Figure 6:
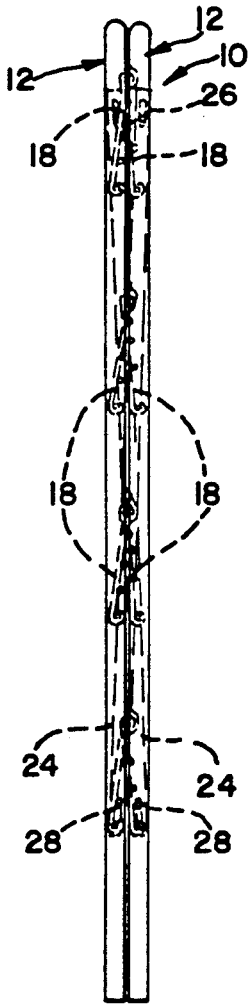
FIG. 6 is a side elevational view of the storage rack shown in FIG. 1, illustrating the storage rack in a fully collapsed position, with shelf assemblies thereof substantially nested within the associated frame members of the storage rack.

The manner in which the present shelf assembly is movable for opening and collapsing is illustrated in FIGS. 4, 5, and 6. By virtue of the hingedly collapsible nature of the shelf assemblies, movement of the frame members 12 toward each other folds and collapses each shelf assembly by upward hinging movement thereof. Thus, the storage rack is movable from the open condition, illustrated in FIG. 4, through the partially collapsed condition shown in FIG. 5, to the fully collapsed condition shown in FIG. 6.

As will be particularly noted in FIG. 6, each of the shelf assemblies has a thickness dimension, when folded and collapsed, which is less than the combined thickness of a pair of the leg portions 14 of the frame members 12. In this manner, all of the shelf assemblies are substantially nested within the peripheries of the respective adjacent frame members when the frame members are juxtaposed and the storage rack is collapsed.

Movement into this orientation is further facilitated by vertically spacing the shelf assemblies from each other sufficiently so that the shelf assemblies do not interfere and contact each other when the storage rack is collapsed. Additionally, the uppermost one of the shelf assemblies is spaced sufficiently downwardly from the upper connector portions 16 of the respective frame members 12 so that, when the storage rack is folded with the frame members juxtaposed, the uppermost shelf assembly is positioned beneath the connector portions 16 of the respective frame members. Folding and collapsing in this manner, with substantial nesting of all of the shelf assemblies, is achieved with all embodiments of the present invention, including the storage rack 10, 110, and variants thereof.

In the preferred embodiment, secure storage of articles on each shelf assembly is facilitated by configuring each shelf assembly with a self-locking arrangement. To this end, one of the shelf portions 18 of each shelf assembly includes a locking finger 22 (see FIGS. 7 and 8) which is engageable with the other shelf portion 18 of the shelf assembly for locking the shelf portions against downward hinging movement from a generally horizontal position thereof. As illustrated, each locking finger 22 is engageable with an upwardly facing surface of the other one of the shelf portions, thus acting to secure each shelf assembly against downward hinging movement when the storage rack is in use.

Figure 7:
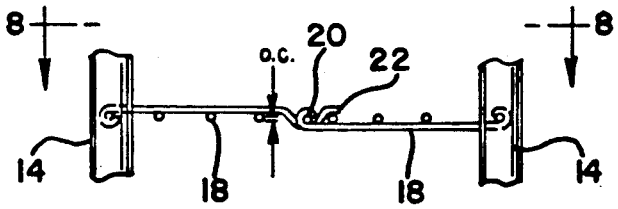
FIG. 7 is a fragmentary, side elevational view illustrating a shelf assembly of the present storage rack.

Additionally, each shelf assembly is preferably positioned in an over-center locking position when extending generally horizontally for use of the storage rack. Specifically, as the storage rack is opened by moving frame members 12 away from each other, each shelf assembly hinges and unfolds as its shelf portions 18 move downwardly and open about the respective hinge point 20. The hinge point 20 moves downwardly through its center position, relative to the respective hinge connections of each shelf portion 18 to the associated frame members 12, with the hinge point 20 thereafter moving to an over-center position relative to the hinge connections of the shelf portions to the frame members. This is illustrated in FIG. 7, wherein the arrows at 0° C. show the disposition of hinge point 20 below an imaginary line extending between the hinge connections of the shelf portions 18 to the leg portions 14 of the associated frame members.

The stability and structural integrity of the present storage rack is further facilitated by the preferred provision of a pair of intersecting cross-braces 24 which extend between respective ones of the leg portions 14 of each adjacent pair of the frame members 12. The cross-braces act in concert with the shelf assemblies to secure the frame members 12 in spaced apart relationship, with the cross-braces further lending to the general rigidity of the storage rack construction.

Each of the cross-braces 24 is joined to a respective one of the frame members 12 by an upper pivot 26, with each cross-brace 24 further joined to an adjacent frame member 12 by a lower pivot 28. A pivot 30 is preferably provided at the intersection of the cross-braces, whereby a scissors-like, collapsible arrangement is provided. Each cross-brace.24 defines a slot 32 at the upper extent thereof, with the respective upper pivot 26 being movable within the respective slot 32 during closing and collapsing movement of the storage rack by movement of the frame members 12 toward each other.

Stability of the present storage rack is particularly enhanced by the cooperation of the cross-braces 24 with the over-center locking shelf assemblies. Specifically, the cross-braces act to limit the movement of the respective frame members 12 away from each other during opening of the rack. During opening, each shelf assembly moves through its center position, and into its over-center locking position, when the respective frame members are at the outer limit of movement away from each other. The resilience of the rack construction permits the shelf assemblies to each move through the center position, and thereafter be urged and generally biased into the over-center position.

Thus, each shelf assembly is: (1) self-locking by virtue of the arrangement by which downward force (such as by an article on the shelf) urges the shelf and the rack open and into a locked position; and (2) maintained in an over-center locking position by the cross-braces 24, acting on the shelf by limiting movement of the frame members away from each other.

Use of the present storage rack is greatly facilitated by its integrated, pre-assembled configuration. Storage rack 10 is quickly opened, in just a matter of seconds, from its collapsed configuration shown, shown in FIG. 6, to its open configuration, shown in FIGS. 1 and 4, by merely moving the pair of frame members 12 away from each other. By this action, each of the shelf assemblies, including the shelf portions 18, unfold by downward hinging movement, with the associated cross-braces 24 opening as the frame members are moved apart. When each shelf assembly is moved into its over-center position, with its locking fingers 22 positioned for locking engagement, the storage rack is fully opened and ready for use.

Collapsing of the storage rack is accomplished in a similarly efficient manner. First, each of the shelf assemblies must be moved from its over-center position, which is readily accomplished by sequentially moving each of the shelf assemblies upwardly slightly, from its over-center position through its center position. When the last of the shelf assemblies is manipulated in this manner, the frame members 12 can be easily moved toward each other, thus folding the shelf assemblies and collapsing the storage rack. When the storage rack is configured in accordance with the embodiment shown in FIG. 2, each shelf assembly of each tier of assemblies is manipulated in the above manner from its over-center position, with the respective adjacent frame members 12 thereafter moved toward each other. After the first tier of the shelf assemblies is manipulated in this manner, the next tier of shelf assemblies may be similarly manipulated, thus permitting the entire storage rack construction to be collapsed to an extremely compact, readily handled form.

Figure 8:
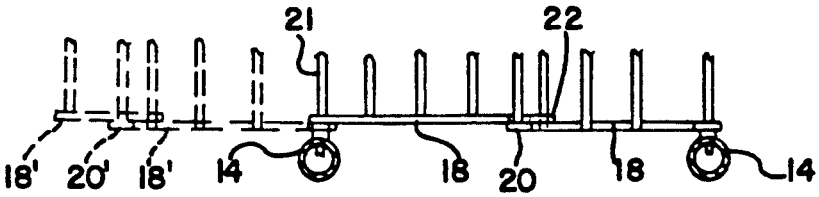
FIG. 8 is a cross-sectional view taken along lines 8—8 of FIG. 7.

Preferred features of the present invention facilitate economical use and compact storage. As shown in FIG. 8, one of the shelf portion 18 of each shelf assembly is narrower than the other, wider one of the shelf portions. In FIG. 8, the left-hand shelf portion 18, shown in solid line, is wider than the right-hand shelf portion 18 (it being understood that the opposite side edges of the shelf portions, not shown in FIG. 8, are arranged in mirror-image relationship to the side edges which are shown).

To facilitate compact collapsing of the storage rack, adjacent shelf assemblies of respective adjacent tiers of the shelf assemblies are arranged in laterally nested relationship. Specifically, the narrower shelf portion of one shelf assembly is partially nested within the wider shelf portion of an adjacent shelf assembly. This relationship is illustrated in phantom line in FIG. 8, wherein the left-hand shelf portion 18 (shown in solid line) is partially nested within the wider shelf-portion 18' (shown in phantom line) of an adjacent shelf assembly of an adjacent tier. Notably, these partially nested shelf portions are preferably hingedly joined to the respective frame member 12 by a common one of the hinge members 21, as shown.

Figure 3:
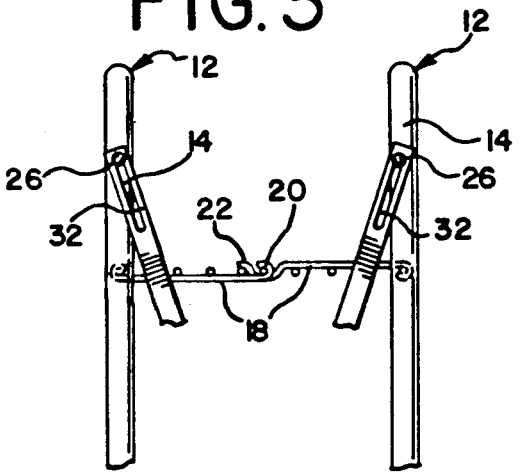
FIG. 3 is a fragmentary, side elevational view of the collapsible storage rack shown in FIG. 1.
Figure 3A:
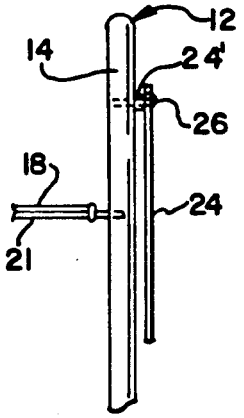
FIG. 3A is a further fragmentary, side elevational view of the collapsible storage rack shown in FIG. 1.

This arrangement of the shelf assemblies permits the present construction to be readily configured with two, three, etc., tiers of shelf assemblies. Versatility in this regard is further provided by arranging cross-braces 24 in a repeating pattern. Referring to the orientation of FIG. 2, each cross-brace 24, which extends from the lower left to the upper right, is positioned outwardly of the respective cross-brace to which it is joined by pivot 30. Where an outer one of the cross-braces is pivotally connected to a frame member 12 arranged at an end of a multi-tiered rack construction, a spacer 24' (FIG. 3A) spaces the cross-brace from the frame member, thus assuring the scissors-like movement of the cross-braces without binding on each other.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover by the appended claims all such modifications as fall within the scope of the claims.

What is claimed is:

1. A collapsible storage rack, comprising:

a plurality of upstanding, generally inverted U-shaped frame members positioned in generally parallel relationship to each other, each said frame member comprising tubular material, and including a pair of spaced apart vertical leg portions, and an upper, horizontal connector portion extending integrally between said leg portions;

a tier of a plurality of vertically spaced, hingedly collapsible shelf assemblies extending between adjacent ones of said frame members, each said shelf assembly comprising a pair of shelf portions hingedly joined to each other, and respectively hingedly joined to said frame members so that movement of said frame members toward each other folds and collapses each said shelf assembly by upward hinging movement thereof; and cross-brace means comprising a pair of intersecting cross-braces positioned to extend between respective ones of the leg portions of each adjacent pair of said frame members, said cross-brace means securing said frame members in spaced apart relationship, with said shelf assemblies extending between said adjacent frame members for use of said storage rack, said cross-brace means being movable to permit said frame members to be moved toward each other and juxtaposed for collapsing said shelf assemblies and said storage rack, said shelf assemblies extending between adjacent ones of said frame members being vertically spaced from each other sufficiently so that the shelf assemblies do not interfere with and contact each other when said storage rack is collapsed, each uppermost one of said shelf assemblies being spaced sufficiently downwardly from the upper connector portions of the respective frame members so that, when the storage rack is folded with said frame members juxtaposed, said uppermost shelf assembly is positioned beneath the connector portions of the respective frame members.

2. A collapsible storage rack in accordance with claim 1, wherein said collapsible storage rack includes a pair of said frame members.

3. A collapsible storage rack in accordance with claim 1, wherein said collapsible storage rack includes three of said frame members, with a plurality of said vertically spaced shelf members extending between adjacent ones of said frame members.

4. A collapsible storage rack in accordance with claim 1, wherein each said shelf assembly, when folded, has a thickness dimension less than the combined thickness of a pair of said leg portions of said frame members, whereby all of said shelf assemblies are substantially nested within the peripheries of the respective adjacent frame members when said frame members are juxtaposed and the storage rack is collapsed.

5. A collapsible storage rack in accordance with claim 1, wherein one of the shelf portions of each said shelf assemblies includes locking means engageable with the other shelf portion of the respective shelf assembly for locking the shelf portions thereof against downward hinging movement from an open position thereof.

6. A collapsible storage rack in accordance with claim 5, wherein said locking means comprises at least one locking finger engageable with an upwardly facing surface of said other shelf portion.

7. A collapsible storage rack in accordance with claim 5, wherein each said shelf assembly is positioned in an over-center locking position when extending generally horizontally for use of said storage rack.

8. A collapsible storage rack in accordance with claim 1, wherein one of said shelf portions of each said shelf assembly is narrower than the other, wider one of said shelf portions, adjacent shelf assemblies of respective adjacent tiers of said shelf assemblies being arranged in laterally nested relationship, with the narrower shelf portion of one shelf assembly partially nested within the wider shelf portion of the adjacent shelf assembly.

9. A collapsible storage rack, comprising:

a plurality of upstanding frame members positioned in generally parallel relationship to each other, each said frame member including a pair of spaced apart vertical leg portions, and an upper, horizontal connector portion extending integrally between said leg portions;

a tier of a plurality of vertically spaced, hingedly collapsible shelf assemblies extending between adjacent ones of said frame members, each said shelf assembly comprising a pair of shelf portions hingedly joined to each other, and respectively hingedly joined to said frame members so that movement of said frame members toward each other folds and collapses each said shelf assembly by upward hinging movement thereof; and cross-brace means positioned to extend between respective ones of the leg portions of each adjacent pair of said frame members, said cross-brace means permitting said frame members to be moved into spaced apart relationship, with said shelf assemblies extending between said adjacent frame members for use of said storage rack, said cross-brace means being movable to permit said frame members to be moved toward each other and juxtaposed for collapsing said shelf assemblies and said storage rack, said cross-brace means being configured to limit movement of said frame members away from each other;

at least one of said shelf assemblies being positioned in an over-center locking position when open for use of said rack, said at least one shelf being movable through a center position thereof when the respective frame members are at an outer limit of movement away from each other, as limited by said cross-brace means.

10. A collapsible storage rack in accordance with claim 9, wherein each said shelf assembly, when folded, has a thickness dimension less than the combined thickness of a pair of said leg portions of said frame members, whereby all of said shelf assemblies are substantially nested within the peripheries of the respective adjacent frame members when said frame members are juxtaposed and the storage rack is collapsed.

11. A collapsible storage rack in accordance with claim 9, wherein one of the shelf portions of each said shelf assemblies includes locking means engageable with the other shelf portion of the respective shelf assembly for locking the shelf portions thereof against downward hinging movement from a generally horizontal position thereof.

12. A collapsible storage rack in accordance with claim 9, wherein one of said shelf portions of each said shelf assembly is narrower than the other, wider one of said shelf portions, adjacent shelf assemblies of respective adjacent tiers of said shelf assemblies being arranged in laterally nested relationship, with the narrower shelf portion of one shelf assembly partially nested within the wider shelf portion of the adjacent shelf assembly.

13. A collapsible storage rack in accordance with claim 12, wherein said partially nested shelf portions are hingedly joined to the respective one of said frame members by common hinge means.

* * * * *